US005374494A

United States Patent [19]

Kashimura et al.

[11] Patent Number: 5,374,494

[45] Date of Patent: Dec. 20, 1994

[54] ELECTROPHOTOGRAPHIC PHOTOSENSITIVE MEMBER, ELECTROPHOTOGRAPHIC APPARATUS, DEVICE UNIT, AND FACSIMILE MACHINE EMPLOYING THE SAME

[75] Inventors: Noboru Kashimura, Tokyo; Harumi Sakoh, Kawasaki, both of Japan

[73] Assignee: Canon Kabushiki Kaisha, Tokyo, Japan

[21] Appl. No.: 68,839

[22] Filed: May 27, 1993

Related U.S. Application Data

[63] Continuation of Ser. No. 849,989, Mar. 12, 1992, abandoned.

[30] Foreign Application Priority Data

Mar. 13, 1991 [JP] Japan ..... 3-072081
Mar. 13, 1991 [JP] Japan ..... 3-072082

[51] Int. Cl.[5] ..... G03G 5/14

[52] U.S. Cl. ..... 430/67; 430/96; 358/296

[58] Field of Search ..... 430/67, 66, 96; 358/296

[56] References Cited

U.S. PATENT DOCUMENTS 4,877,701 10/1989 Hiro et al. ..... 430/59
5,059,511 10/1991 Higashi et al. ..... 430/272
5,096,796 3/1992 Mammino et al. ..... 430/67

FOREIGN PATENT DOCUMENTS 0460558 12/1991 European Pat. Off. .... G03G 5/147
4006284 8/1990 Germany ..... G03F 7/028
55-85058 6/1980 Japan .
61-41152 2/1986 Japan .
61-201460 9/1986 Japan .
61-201461 9/1986 Japan .
1-116553 5/1989 Japan .
1-134364 5/1989 Japan .
1-134365 5/1989 Japan .

OTHER PUBLICATIONS

Patent Abstract of Japan, vol. 9, No. 253, (P-395) [1976], Oct. 11, 1985.

*Primary Examiner*—John Goodrow
*Attorney, Agent, or Firm*—Fitzpatrick, Cella, Harper & Scinto

[57] ABSTRACT

The present invention provides an electrophotographic photosensitive member which has a surface layer of high hardness, high resistance to abrasion and scratching, and high durability. The surface layer of the photosensitive member contains a polymerization product of a monomer compound represented by the formula (1) or (2).

(1)

(2)

15 Claims, 3 Drawing Sheets

ELECTROPHOTOGRAPHIC PHOTOSENSITIVE MEMBER, ELECTROPHOTOGRAPHIC APPARATUS, DEVICE UNIT, AND FACSIMILE MACHINE EMPLOYING THE SAME

This application is a continuation of application Ser. No. 07/849,989 filed Mar. 12, 1992, now abandoned.

BACKGROUND OF THE INVENTION

1. Field of the Invention

The present invention relates to an electrophotographic photosensitive member, particularly to an electrophotographic photosensitive member having superior surface hardness and abrasion resistance. The present invention relates also to an electrophotographic apparatus, a device unit, and a facsimile machine employing that electrophotographic photosensitive member.

2. Related Background Art

Electrophotographic photosensitive members are widely used mediums for image formation in the electrophotographic process such as a copying machine, a laser beam printer, and a facsimile machine. In a usual electrophotographic image forming process, the electrophotographic photosensitive member is repeatedly subjected to a cycle of electric charging, exposure to light, development of the image, transfer of the developed image, cleaning, and removal of the electric charge. In more detail, firstly an electrophotographic photosensitive member is electrostatically charged uniformly. The uniformly charged photosensitive member is imagewisely exposed to light by use of a halogen lamp, a laser beam, or the like to decay the charged potential at the light-exposed area, thus forming an electrostatic latent image. Then the electrostatic latent image is developed with a developing agent (i.e., a toner composed of charged fine particles) to form a visible image on the electrophotographic photosensitive member. The visible image is transferred onto an image receiving material by Coulomb's force caused by transfer charging and pressure application. In the image transfer, not all of the toner is transferred, but a portion of the toner remains on the electrophotographic photosensitive member. The remaining toner has to be removed by cleaning for repeated use of the photosensitive member. After the cleaning, the influence of the previous staticization is removed by intense light exposure, bias application or the like method to make the photosensitive member ready for the next process cycle.

The cleaning process is explained below in more detail. In the cleaning process, the fine particles such as toner particles are removed from the surface of a photosensitive member using a fur brush, a magnetic brush, a blade, OF the like means. In particular, blade cleaning is widely employed in recent years because of the high effectiveness of cleaning and the simple constitution of the cleaning device. The cleaning blade is constituted of a blade 1, namely a plate made of an elastic material like polyurethane, and a support 2 for holding the blade as shown in FIG. 1 to FIG. 4. The blade is pressed against the photosensitive member along the length direction of the photosensitive member. The blade may be brought into contact either in the direction following the rotation of the photosensitive member 3 as shown in FIG. 5 or in the direction counter to the rotation as shown in FIG. 6. The latter direction of the contact is preferred in view of the cleaning efficiency. Higher pressure of contact of the blade 1 to the photosensitive member 3 is preferable for further improvement of the cleaning efficiency.

The improvement of the cleaning efficiency is especially important in order to maintain the image quality in repeated use. However, a higher contact pressure results in the increase of frictional force between the photosensitive member and the blade, which causes abrasion and scratches of the photosensitive member, thus shortening the life of the photosensitive member.

On the other hand, organic photosensitive materials mainly used as the electrophotographic photosensitive member because of the advantages of high productivity, low cost, and non-pollution, have lower surface hardness than the ones employing an inorganic photoconductive material, and the surface is liable to be abraded and scraped by the cleaning blade.

To avoid such disadvantages, many attempts have been made to obtain a photosensitive layer having high hardness using polymerization of a monomer or an oligomer. For example, the attempts are disclosed in Japanese Laid-Open Patent Application Nos. 55-85058, 61-41152, 61-201461, 62-201460, 1-116553, 1-134364, 1-134365, and so forth.

However, the monomers, oligomers, and the polymerization products are sometimes not sufficiently compatible with or dispersible in photoconductive compounds, and the photoconductive compounds tend to deteriorate in the polymerization step.

To meet the recent needs for further higher image quality and higher durability, electrophotographic photosensitive members are being investigated which have higher mechanical strength.

SUMMARY OF THE INVENTION

The present invention intends to provide an electrophotographic photosensitive member which has a surface layer of high hardness, high resistance to abrasion and scratching, and high durability.

The present invention also intends to provide an electrophotographic apparatus, a device unit, and a facsimile machine employing the above electrophotographic photosensitive member.

The present invention provides an electrophotographic photosensitive member, comprising an electroconductive support and a photosensitive layer formed thereon, the surface layer of the electrophotographic photosensitive member containing a polymerization reaction product of a monomer compound represented by the formula (1) or (2):

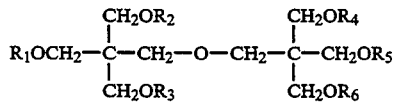

(1)

wherein $R_1$, $R_2$, $R_3$, $R_4$, $R_5$, and $R_6$ are independently hydrogen or $—R_7—C(R_8)=CH_2$, $R_7$ being a substituted or unsubstituted alkylene group, —O—, —CO—, —NH—, or —S—, or a group derived by combination thereof, $R_8$ being hydrogen, methyl, or phenyl, and not more than one of $R_1$ to $R_6$ are simultaneously hydrogen;

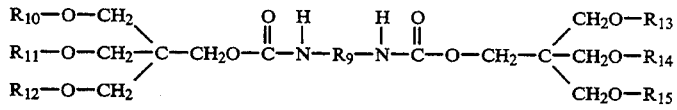

(2)

wherein $R_9$ is an alkylene group, an arylene group, a bivalent heterocyclic group or a group derived by combination thereof which may be substituted, and $R_{10}$, $R_{11}$, $R_{12}$, $R_{13}$, $R_{14}$, and $R_{15}$ are independently hydrogen or $—R_{16}—C(R_{17})=CH_2$, $R_{16}$ being a substituted or unsubstituted alkylene group, —O—, —CO—, —NH—, or —S—, or a group derived by combination thereof, $R_{17}$ being hydrogen, methyl, or phenyl, and not more than one of $R_{10}$ to $R_{15}$ are simultaneously hydrogen.

The present invention also provides an electrophotographic apparatus, a device unit, and a facsimile machine employing the above-specified electrophotographic photosensitive member.

DETAILED DESCRIPTION OF THE PREFERRED EMBODIMENTS

Figure 1:
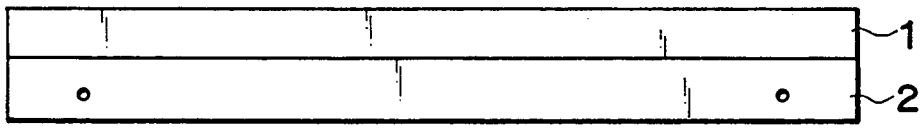
FIG. 1 illustrates a plan view of an example of the cleaning blade.
Figure 2:
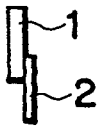
FIG. 2 illustrates a side view of an example of the cleaning blade
Figure 3:
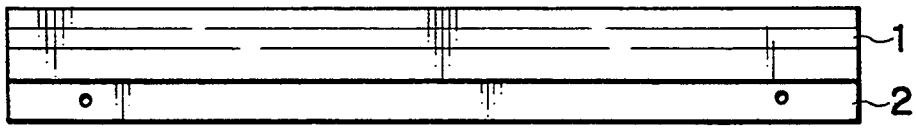
FIG. 3 illustrates a plan view of another example of the cleaning blade.
Figure 4:
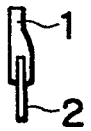
FIG. 4 illustrates a side view of another example of the cleaning blade.
Figure 5:
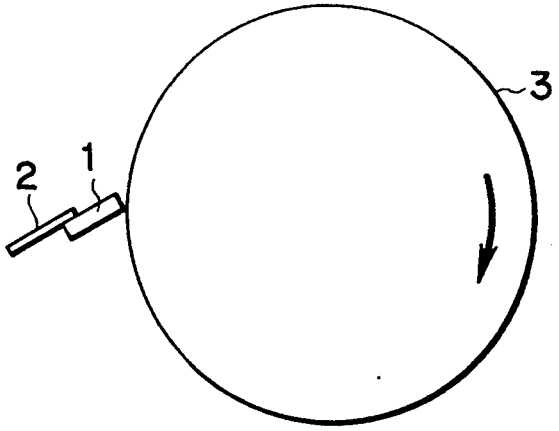
FIG. 5 illustrates the state of contact of the blade with the photosensitive member in the direction following the rotation of the photosensitive member.
Figure 6:
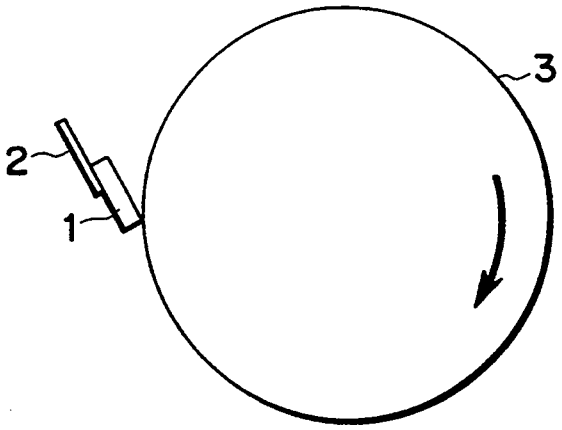
FIG. 6 illustrates the state of contact of the blade with the photosensitive member in the direction counter to the rotation of the photosensitive member.

The electrophotographic photosensitive member of the present invention has a surface layer which contains a polymerization reaction product of a monomer compound represented by the formula (1) or (2):

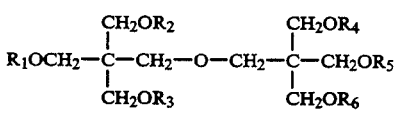

(1)

wherein $R_1$, $R_2$, $R_3$, $R_4$, $R_5$, and $R_6$ are independently hydrogen or $—R_7—C(R_8)=CH_2$, $R_7$ being a substituted or unsubstituted alkylene group, —O—, —CO—, —NH—, or —S—, or a group derived by combination thereof, $R_8$ being hydrogen, methyl, or phenyl, and not more than one of $R_1$ to $R_6$ are simultaneously hydrogen;

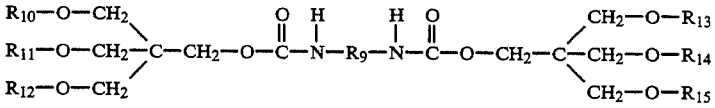

(2)

wherein $R_9$ is an alkylene group, an arylene group, a bivalent heterocyclic group or a group derived by combination thereof which may be substituted, and $R_{10}$, $R_{11}$, $R_{12}$, $R_{13}$, $R_{14}$, and $R_{15}$ are independently hydrogen or $—R_{16}—C(R_{17})=CH_2$, $R_{16}$ being a substituted or unsubstituted alkylene group, —O—, —CO—, —NH—, or —S—, or a group derived by combination thereof, $R_{17}$ being hydrogen, methyl, or phenyl, and not more than one of $R_{10}$ to $R_{15}$ are simultaneously hydrogen.

The groups $R_1$ to $R_7$ in Formula (1) and the groups $R_{10}$ to $R_{15}$ in Formula (2) include specifically those shown below in addition to hydrogen. The present invention, however, is not limited thereto.

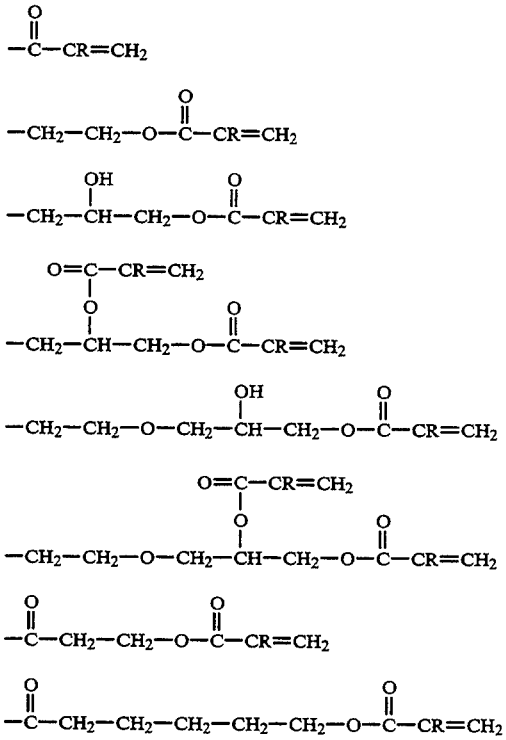

In the formulas above, R denotes $R_8$ or $R_{17}$. $R_8$ and $R_{17}$ are preferably hydrogen.

The groups $R_1$ to $R_7$ and $R_{10}$ to $R_{15}$ may be the same or different, but two or more thereof are not simultaneously hydrogen.

$R_9$ includes specifically the groups shown below, but is not limited thereto in the present invention.

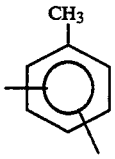

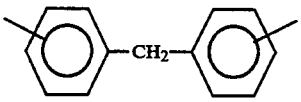

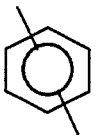

$-(CH_2)_n-$ (n = integer)

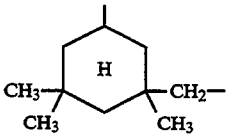

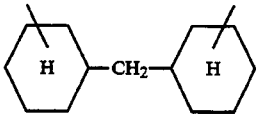

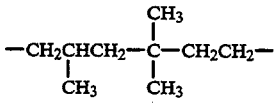

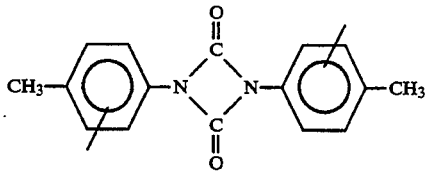

From among the above groups, preferable are

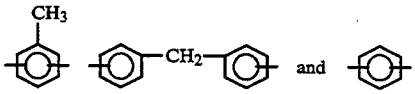

Particularly more suitable are

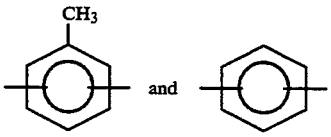

As the compound represented by Formula (1), the one shown below is particularly preferred.

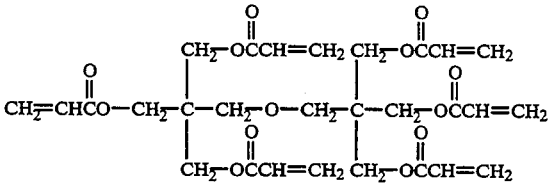

The compounds employed in the present invention are polymerizable by radical polymerization. The compounds are monomers which have the functional groups in extremely high density and will react extremely rapidly. Since the polymerization proceeds under mild conditions, the photoconductive substances are not damaged by the polymerization. Furthermore, the compounds of the present invention are highly compatible with and highly dispersible in the photoconductive substances, and have sufficiently high density of the functional groups, which gives greatly high hardness of the polymerization products (the "reaction product" of the compounds of the present invention).

For polymerizing the aforementioned monomer in the present invention, a radical generating polymerization initiator is used. The radical includes thermoradicals and photoradicals.

Thermal polymerization initiator which generates a radical by heating includes peroxides, azo compounds, tetraalkylthiuram disulfides, organometallic compounds, and so forth. These initiators may be used individually or in combination of two or more thereof. Frequently, combined use of the initiators accelerates the polymerization more effectively. Combination of the initiator with a reducing agent may promote the radical generation. The reducing agent includes ferrous salts, tertiary amines, naphthenate salt, mercaptans, organometallic compounds, and so forth.

Specific examples of the thermal polymerization initiator are shown below.

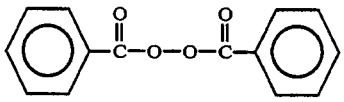

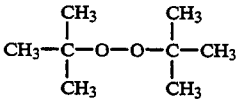

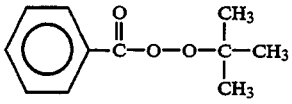

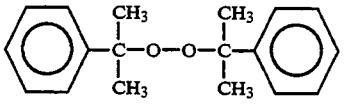

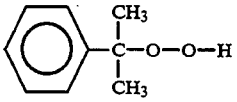

-continued

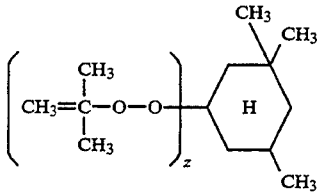

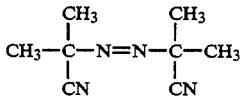

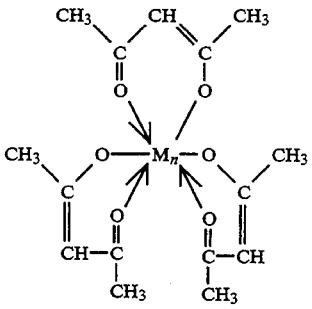

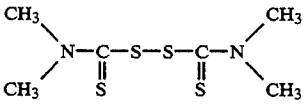

The photopolymerization initiator includes acetophenone, benzoin, benzophenone, thioxanthone, anthraquinone, benzil, camphorquinone, Michler's ketone, and the like. Such initiators generate radicals by irradiation of light in a UV region. The initiator generates radicals more effectively when used combinedly with a photopolymerization promotor such as an amine, a sulfone, and phosphine. Since the photopolymerization initiators have respectively different absorption wavelengths, combination of two or more thereof raises the radical generation efficiency. Alternatively, combined use with sensitizer having an absorption wavelength in a visible region enables radical generation by visible light.

Examples of photopolymerization initiators, photopolymerization promoters, and sensitizers are shown below.

Photopolymerization initiators (a) Acetophenones:

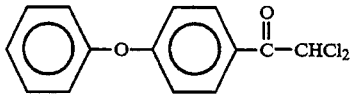

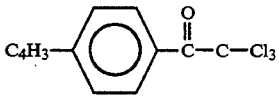

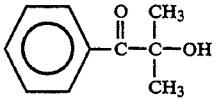

-continued

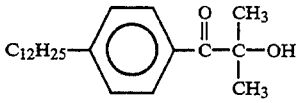

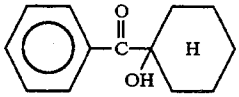

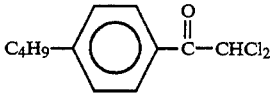

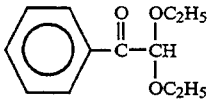

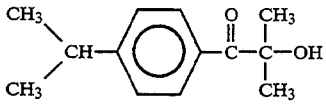

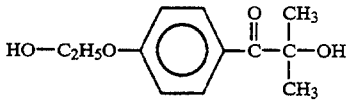

(b) Benzoins:

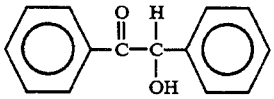

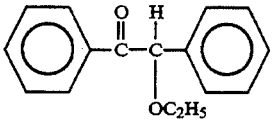

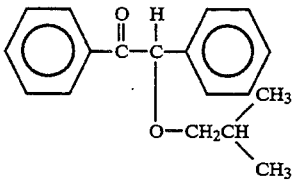

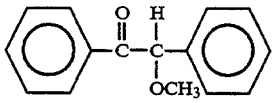

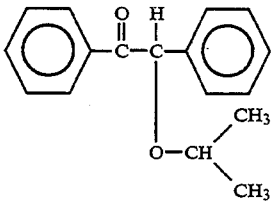

-continued
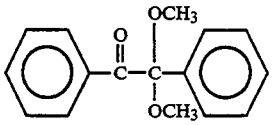
(c) Benzophenones:
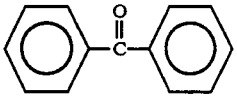
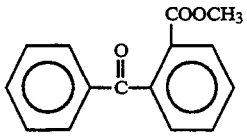
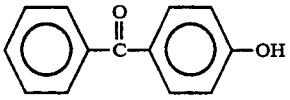
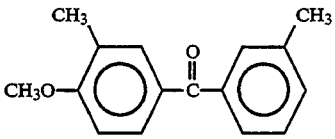
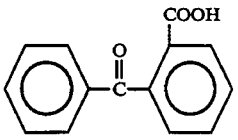
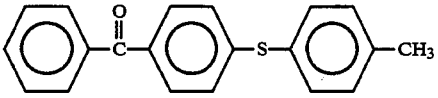
(d) Thioxanthones:
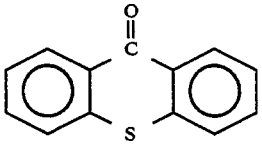
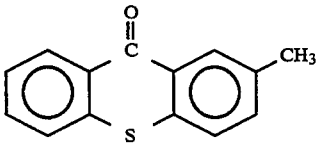
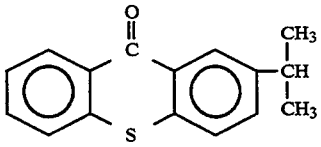
-continued
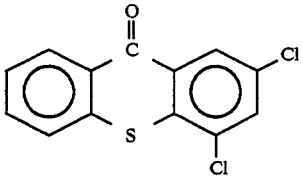
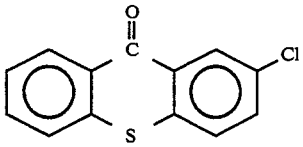
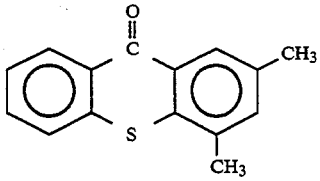
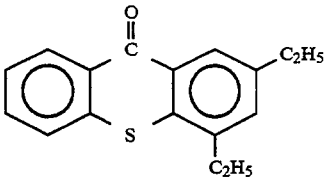
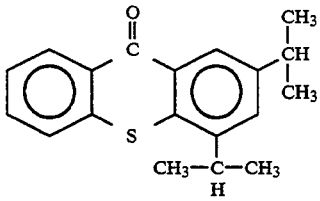
(e) Miscellaneous:
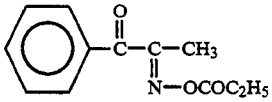
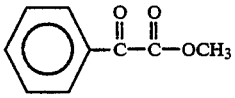
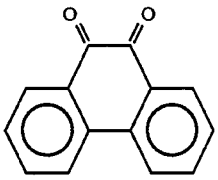
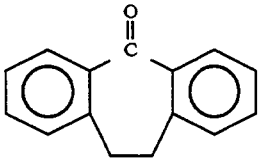
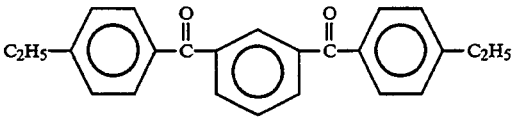

-continued
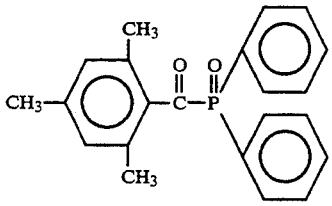
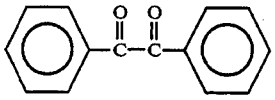
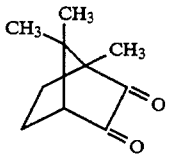
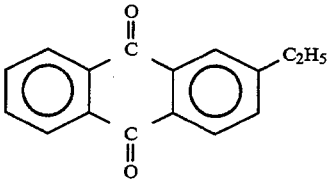
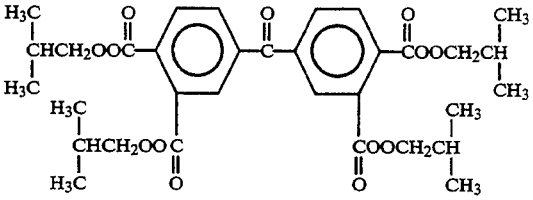
Photopolymerization promotors
$(HOCH_2CH_2)_3N$
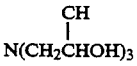
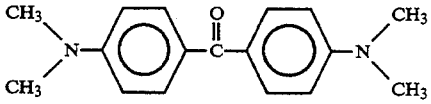
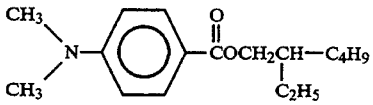
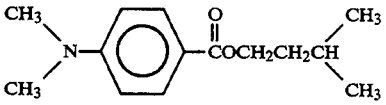
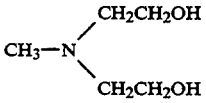
-continued
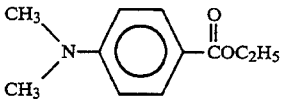
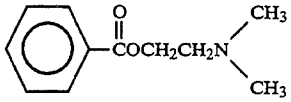
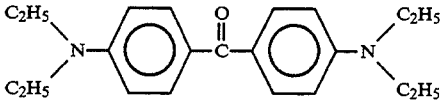
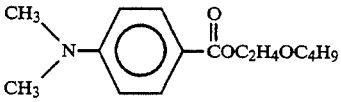
Sensitizers:
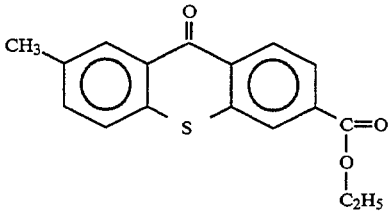
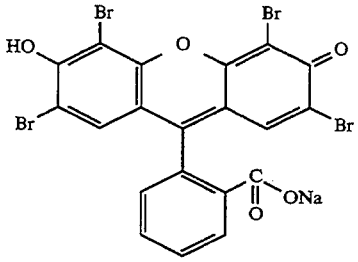
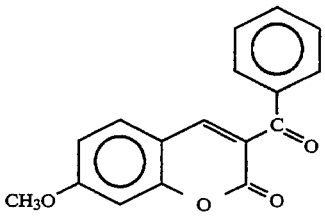
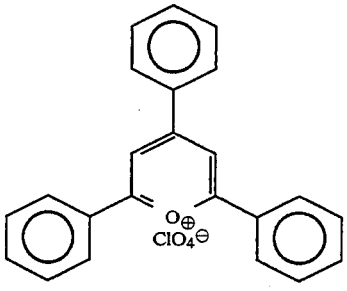
The light source for generating radicals photochemically is suitably selected depending on the kind of the photopolymerization initiator and the sensitizer. The light source includes high-pressure mercury lamps, extra-high-pressure mercury lamps, metal halide lamps, electrodeless lamps, xenon lamps, eximer laser, He-Cd laser, and the like.

Alternatively, irradiation of electron rays generates radicals in a system not containing an initiator to cause polymerization therein. The irradiation of the electron rays may be conducted either by a scanning or non-scanning type.

The monomer of the present invention may be polymerized in the presence of other polymerizable monomer or oligomer, or further in the presence of a high polymer binder. Such high polymer binder includes thermoplastic resins, and the polymerized monomers and oligomers above. The examples are polyesters, polyurethanes, polyacrylates, polyethylenes, polystyrenes, polybutadienes, polycarbonates, polyamides, polypropylenes, polyimides, polyamidoimides, phenol resins, acrylic resins, silicone resins, epoxy resins, urea resins, allyl resins, alkyd resins, melamine resins, nylons, polysulfones, polyaryl ethers, polyacetals, butyral resins, fluororesins, and the like. Among them, polymerizable monomers and oligomers of acrylates, methacrylates and epoxy types have sufficient compatibility, and are desirable in forming mixture systems.

The photosensitive layer in the present invention may be of a single layer type containing both a charge-generating substance and a charge-transporting substance in one and the same layer, or otherwise may be of a lamination type constituted of a charge-generating layer containing a charge-generating substance and a charge-transporting layer containing a charge-transporting substance. In the lamination type, the surface layer may be either a charge-generating layer or a charge-transporting layer. A protecting layer may be provided further on the photosensitive layer as the surface layer in any of the single layer type and the lamination type. In any case of the present invention, the surface layer contains the polymerization product of the monomer of the present invention, which gives high hardness and high abrasion resistance of the surface layer.

The charge-generating substance employed in the present invention includes phthalocyanine pigments, polycyclic quinone pigments, trisazo pigments, disazo pigments, azo pigments, perylene pigments, indigo pigments, quinacridone pigments, azulenium salt pigments, squatilium dyes, cyanine dyes, pyrylium dyes, thiopyrylium dyes, xanthene dyestuffs, quinone imine dyestuffs, triphenylmethane dyestuffs, styryl dyestuffs, selenium, selenium-tellurium alloys, amorphous silicon, cadmium sulfide, and the like.

The charge-transporting substance employed in the present invention includes pyrenes, N-alkylcarbazoles, hydrazones, N,N-dialkylanilines, diphenylamines, triphenylamines, triphenylmethanes, pyrazolines, styryls, stilbenes, and the like.

In the case where the photosensitive layer is a single layer type, the photosensitive layer has a thickness preferably in the range of from 8 to 40 μm, more preferably from 12 to 30 μm, and contains photoconductive substances such as a charge-generating substance and a charge-transporting-substance at a content of preferably from 20 to 80%, more preferably from 30 to 70% by weight based on the total weight of the photosensitive layer.

In the case where the photosensitive layer is a lamination type, the charge-generating layer has a film thickness preferably in the range of from 0.001 to 6 μm, more preferably from 0.01 to 2 μm, and contains a charge-generating substance at a content preferably from 10 to 100%, more preferably from 50 to 100% by weight based on the total weight of the charge-generating layer. The charge-transporting layer has a thickness preferably in the range of from 5 to 70 μm, more preferably from 20 to 50 μm, and contains a charge-transporting substance at a content preferably from 20 to 80%, more preferably from 30 to 70% by weight based on the total weight of the charge-transporting layer.

The protecting layer, if it is provided, has a thickness in the range of preferably from 0.01 to 10 μm, more preferably from 0.1 to 7 μm. The protecting layer, in order to obtain uniform and sufficient electroconductivity, may contain a charge-generating substance or a charge-transporting substance and may contain an electroconductive substance such as metals, oxides, nitrides and salts of the metals, alloys, and carbon. The above metals include iron, copper, gold, silver, lead, zinc, nickel, tin, aluminum, titanium, antimony, indium and so forth. Specific examples of the electroconductive substance are ITO, $TiO_2$, ZnO, $SnO_2$, and $Al_2O_3$. Usually, an electroconductive substance in a fine particle form is dispersed in the protecting layer. The particle diameter thereof is preferably in the range of from 0.001 to 5 μm, more preferably from 0.01 to 1 μm, and the content of the electroconductive substance is preferably in the range of from 1 to 70%, more preferably from 5 to 50% by weight based on the total weight of the protecting layer. Further, as a dispersing agent, the layer may contain a titanium coupling agent, a silane coupling agent, a surfactant or the like.

The layers other than the surface layer need not necessarily contain the polymerization product of the monomer of the present invention, and can be formed from one or more of following highpolymer compounds or a copolymer of following monomers: polyesters, polyurethanes, polyacrylates, polyethylenes, polystyrenes, polybutadienes, polycarbonates, polyamides, polypropylenes, polyimides, phenol resins, acrylic resins, silicone resins, epoxy resins, urea resins, allyl resins, alkyd resins, polyamidoimides, nylons, polysulfones, polyaryl ethers, polyacetals, butyral resins, and the like.

The electroconductive support of the electrophotographic photosensitive member of the present invention may be made of a metal such as iron, copper, gold, silver, aluminum, zinc, titanium, lead, nickel, tin, antimony, and indium; an oxide of the above metals, carbon, an electroconductive polymer, or the like. The shape of the support may be drum like a cylinder or a column, a belt, or a sheet, and it is desirably made fit to the electrophotographic apparatus to be employed. The electroconductive substance may be formed into the support, may be applied as a dispersion in a resin, or may be vapor deposited on a base material. The support may be worked by etching or plasma treatment. When the electroconductive substance is applied by coating, the base material may be paper or plastic as well as a metal or an alloy.

A subbing layer may be provided between the electroconductive support and the photosensitive layer. The subbing layer functions as a barrier layer to control charge injection or as an adhesive layer. The subbing layer is mainly composed of a binder resin, but may contain any of the aforementioned metals, alloys, oxides thereof, salts, and surfactants. The binder resin for forming the subbing layer includes polyesters, polyurethanes, polyacrylates, polyethylenes, polystyrenes, polybutadienes, polycarbonates, polyamides, polypropylenes, polyimides, phenol resins, acrylic resins, silicone resins, epoxy resins, urea resins, allyl resins, alkyd resins, polyamidoimides, nylons, polysulfones, polyaryl ethers, polyacetals, butyral resins, and the like. The subbing layer has a thickness preferably in the range of from 0.05 to 7 μm, more preferably from 0.1 to 2 μm.

The aforementioned respective layers may be formed by vapor deposition, coating or the like method. From among the methods, coating methods are preferred since the coating methods can give a variety of films from thin films to thick films in a various composition. The coating methods include dip coating, spray coating, beam coating, bar coating, blade coating, and roller coating.

The electrophotographic photosensitive member is useful not only for electrophotographic copying machines but also useful in a various fields of electrophotography such as laser beam printers, CRT printers, LED printers, liquid crystal printers, facsimile machines, and laser engraving machines.

Figure 7:
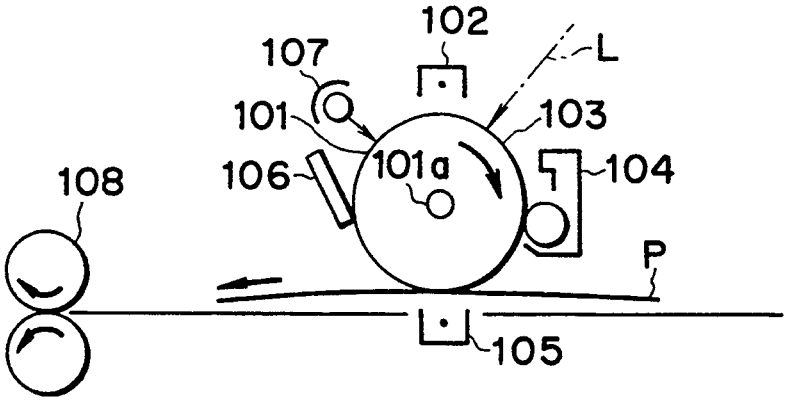
FIG. 7 illustrates an outline of a constitution of an electrophotographic apparatus employing the electrophotographic photosensitive member of the present invention.
Figure 8:
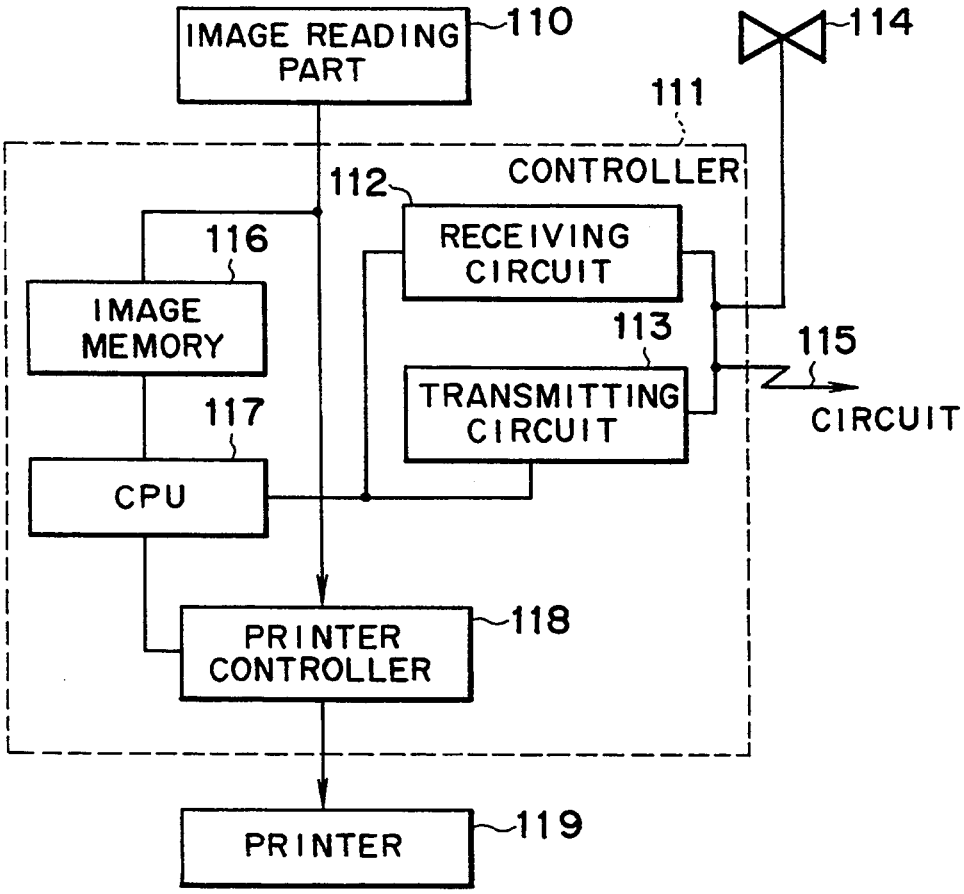
FIG. 8 illustrates an example of a block diagram of a facsimile employing the electrophotographic photosensitive member of the present invention.

FIG. 7 illustrates an outline of an example of the constitution of an electrophotographic apparatus employing the electrophotographic photosensitive member of the present invention. FIG. 8 illustrates an example of a block diagram of a facsimile employing the electrophotographic photosensitive member of the present invention.

In FIG. 7, an electrophotographic photosensitive member 101 serves as an image carrier, being driven to rotate around the axis 101*a* in the arrow direction at a predetermined peripheral speed. The electrophotographic photosensitive member 101 is uniformly charged positively or negatively at the peripheral face by an electrostatic charging means 102 during the rotation, and then exposed to image-exposure light L (e.g. slit exposure, laser beam-scanning exposure, etc.) at the exposure part 103 with an image-exposure means (not shown in the figure), whereby electrostatic latent images are sequentially formed on the peripheral surface in accordance with the exposed image.

The electrostatic latent image is developed with a toner by a developing means 104. The toner-developed images are sequentially transferred by a transfer means 105 onto a surface of a transfer-receiving material P which is fed between the photosensitive member 101 and the transfer means 105 synchronizing with the rotation of the photosensitive member 101, from a transfer-receiving material feeder not shown in the figure.

The transfer-receiving material P having received the transferred image is separated from the photosensitive member surface, and introduced to an image fixing means 108 for fixation of the image and sent out from the copying machine as a duplicate copy.

The surface of the photosensitive member 101, after the image transfer, is cleaned with a cleaning means 106 to remove any remaining un-transferred toner, and is treated for charge-elimination with a pre-exposure means 107 for repeated use for image formation.

The generally employed charging means 102 for uniformly charging the photosensitive member 101 is a corona charging apparatus. The generally employed transfer means 105 is also a corona charging means. In the electrophotographic apparatus, two or more of the constitutional elements of the above described photosensitive member, the developing means, the cleaning means, etc. may be integrated into one device unit, which may be made removable from the main body of the apparatus. For example, a cleaning means 106 is combined with the photosensitive member 101 into one device unit which is removable from the main body of the apparatus by aid of a guiding means such as a rail in the main body of the apparatus. An electrostatic charging means and/or a developing means may be combined with the aforementioned device unit.

When the electrophotographic apparatus is used as a copying machine or a printer, the light L for optical image exposure may be projected onto the photosensitive member as reflected light or transmitted light from an original copy, or otherwise the information read out by a sensor from an original may be signalized, and according to the signal, light L is projected onto a photosensitive member, by scanning with a laser beam, driving an LED array, or driving a liquid crystal shutter array.

When the electrophotographic apparatus is used as a printer of a facsimile machine, the optical image exposure light L is for printing the received data. FIG. 8 is a block diagram of an example of this case.

A controller 111 controls an image reading part 110 and a printer 119. The entire of the controller 111 is controlled by a CPU 117. Readout data from the image reading part 110 is transmitted through a transmitting circuit 113 to the other communication station. Data received from the other communication station is transmitted through a receiving circuit 112 to a printer 119. The image data is stored in image memory 116. A printer controller 118 controls a printer 119. The numeral 114 denotes a telephone set.

The image received through a circuit 115, namely image information from a remote terminal connected through the circuit, is demodulated by the receiving circuit 112, treated for decoding of the image information in CPU 117, and successively stored in the image memory 116. When at least one page of image information has been stored in the image memory 116, the images are recorded in such a manner that the CPU 117 reads out the one page of image information, and sends out the decoded one page of information to the printer controller 118, which controls the printer 119 on receiving the one page of information from CPU 117 to record the image information.

During recording by the printer 119, the CPU 117 receives the subsequent page of information.

Images are received and recorded in the manner as described above.

The present invention is described in more detail by reference to examples.

In Examples, the term "part" as a unit of quantities is based on weight unless otherwise mentioned.

EXAMPLE 1

A solution was prepared by mixing 10 parts of nylon (M-4000, trade name, made by Toray Industries, Inc.), 100 parts of methanol, and 90 parts of isopropanol. The resulting solution was applied by dip coating onto an aluminum cylinder having an outer diameter of 80 mm, a wall thickness of 1.5 mm, and a length of 363 mm, and the applied solution was dried at 90° C. for 20 minutes to form a subbing layer of 2.0 μm thick.

Then, a paint for a charge-generating layer was prepared by dispersing 10 parts of the trisazo pigment represented by the formula below:

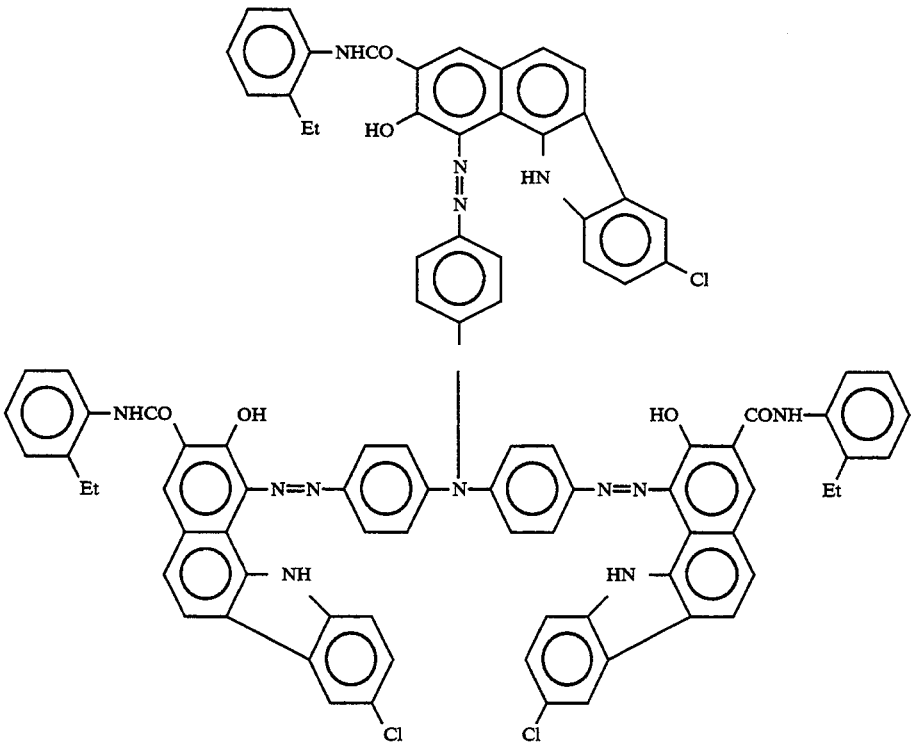

and 5 parts of a polycarbonate resin (bisphenol A type, weight-average molecular weight: 20,000) in 600 parts of cyclohexanone by means of a sand mill. This paint was applied onto the above subbing layer by dip coating, and the applied coating was dried at 120° C. for 20 minutes to form a charge-generating layer of 0.15 μm thick.

Then, a solution was prepared by mixing 20 parts of the biphenyl compound of the formula below:

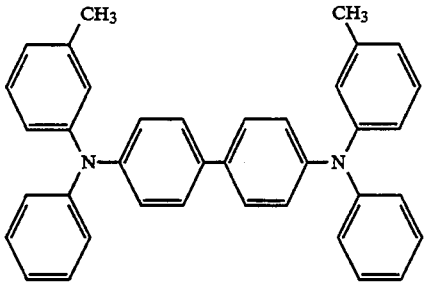

5 parts of the monomer of the formula below:

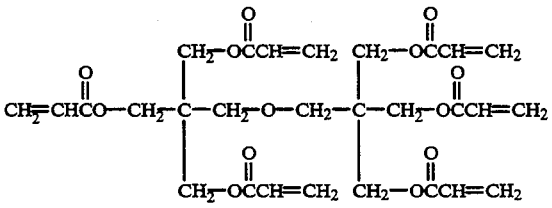

0.15 parts of the polymerization initiator of the formula below:

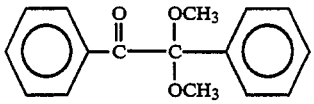

15 parts of a polycarbonate resin (bisphenol A type, weight-average molecular weight: 50,000), and 300 parts of monochlorobenzene. This solution was applied onto the above charge-generating layer by dip coating. The applied solution was dried at 100° C. for 5 minutes. The formed layer was exposed to ultraviolet light irradiation of 1200 $\mu J/cm^2$ by means of a high-pressure mercury lamp, and was further dried at 120° C. for 60 minutes to form a charge-transporting layer of 15 μm thick.

The electrophotographic photosensitive member thus prepared was evaluated according to the test method mentioned below.

(i) Abrasion Test:

Simultaneously with the above photosensitive member, another electrophotographic photosensitive member was prepared by using an aluminum sheet of 50 μm thick as the support in place of the aluminum cylinder. This photosensitive member was subjected to abrasion test of 5000 rotations at the load of 500 g×2 by means of a Taber abrader to measure the loss of weight of the photosensitive member by the abrasion. The result is shown in Table 1.

(ii) Scratch Test:

The surface of the photosensitive member was scratched with a diamond needle of 0.5 mm diameter at a load of 50 g by means of a scratch tester made by Heidon to measure the depth of the scratch. The result is shown in Table 1.

(iii) Test with Commercial Machine:

The photosensitive member was mounted on a color copying machine (CLC-200, made by Canon K.K.). Copying of 20,000 sheets was conducted in full color on A4-size paper sheets. The amount of abrasion of the photosensitive member, the decrease of the dark-area potential, and smear on a solid white image (or fogging) were measured and evaluated. The fogging was evaluated by visual observation. The results are shown in Table 1.

EXAMPLE 2

An electrophotographic photosensitive member was prepared and evaluated in the same manner as in Example 1 except that the monomer below was used in place of the monomer used in Example 1.

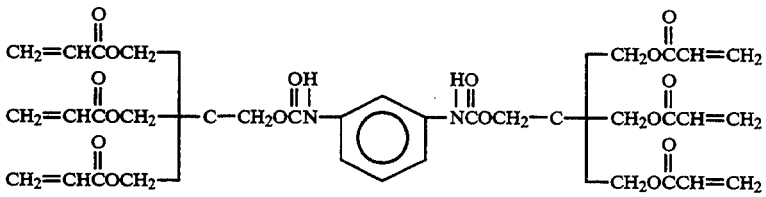

The results are shown in Table 1.

COMPARATIVE EXAMPLE 1

To make the layers up to the charge-generating layer, the same procedure was conducted as in Example 1. Subsequently, a solution was prepared by mixing 20 parts of the biphenyl compound used in Example 1, 20 parts of the polycarbonate resin (bisphenol A type, weight-average molecular weight 50,000) used in Example 1, and 300 parts of monochlorobenzene. This solution was applied by dip coating on the above charge-generating layer, and was dried at 120° C. for 60 minutes to form a charge-transporting layer of 23 μm thick. The resulting electrophotographic photosensitive member was evaluated in the same manner as in Example 1. The results are shown in Table 1.

EXAMPLE 3

A solution was prepared by mixing 10 parts of the monomer used in Example 1, 0.4 part of the photopolymerization initiator used in Example 1, and 90 parts of methyl ethyl ketone. This solution was applied on an electrophotographic photosensitive member which had been prepared in the same manner as in Comparative Example 1 by spray coating. The applied solution was dried at 70° C. for 10 minutes, exposed to ultraviolet light irradiation at 1,200 μJ/cm$^2$, and dried at 120° C. for 60 minutes sequentially to provide a protecting layer of 1.2 μm thick. The resulting electrophotographic photosensitive member was evaluated in the same manner as in Example 1. The results are shown in Table 1.

EXAMPLE 4

An electrophotographic photosensitive member was prepared and evaluated in the same manner as in Example 3 except that the monomer was replaced with the one used in Example 2. The results are shown in Table 1.

COMPARATIVE EXAMPLE 2

An electrophotographic photosensitive member was prepared and evaluated in the same manner as in Example 3 except that the monomer was replaced with the one represented by the formula below.

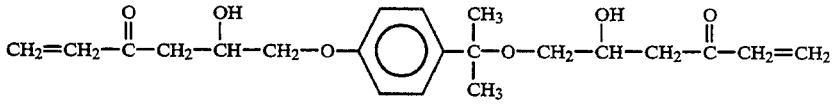

The results are shown in Table 1.

EXAMPLE 5

An electrophotographic photosensitive member was prepared and evaluated in the same manner as in Example 3 except that the monomer and the polymerization initiator were replaced with the ones shown below.

(Monomer)

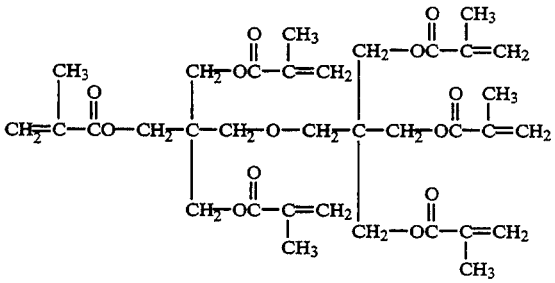

(Polymerization Initiator)

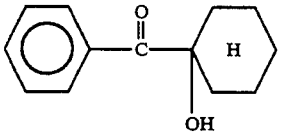

The results are shown in Table 1.

EXAMPLE 6

An electrophotographic photosensitive member was prepared and evaluated in the same manner as in Example 5 except that the monomer was replaced with the monomer represented by the formula below.

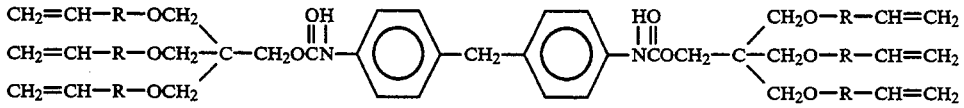

The results are shown in Table 1.

EXAMPLE 7

An electrophotographic photosensitive member was prepared and evaluated in the same manner as in Example 3 except that the monomer and the polymerization initiator were replaced with the ones shown below.

(Monomer)

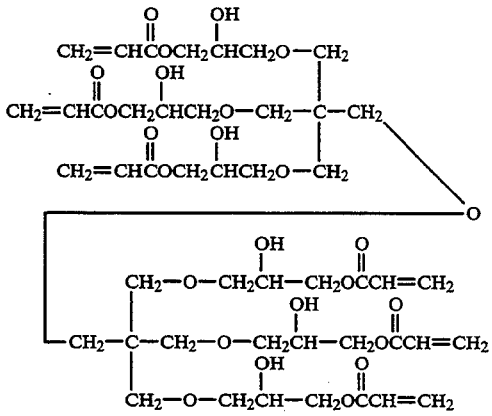

(Polymerization Initiator)

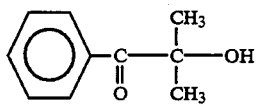

The results are shown in Table 1.

EXAMPLE 8

An electrophotographic photosensitive member was prepared and evaluated in the same manner as in Example 7 except that the monomer was replaced with the one represented by the formula below.

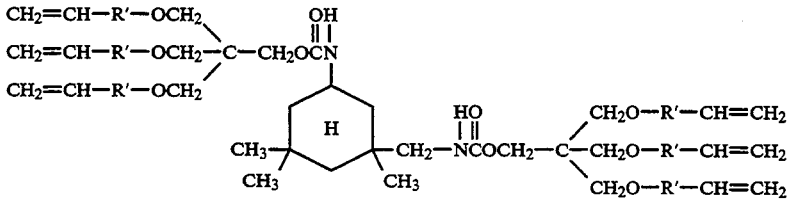

where R′ is a group —C(=O)—. The results are shown in Table 1.

EXAMPLE 9

A subbing layer was provided on a cylinder in the same manner as in Example 1. Then the same charge-transporting layer as in Comparative Example 1 was provided on the subbing layer, and further thereon the same charge-generating layer as in Example 1 was provided. Still further thereon, the same protecting layer as in Example 7 was provided.

The resulting electrophotographic photosensitive member was evaluated in the same manner as in Example 1, except that, in the running test with the commercial machine, the high-voltage transformer was changed so as to reverse the polarity of the primary charging, the image-transfer charging, and the developing bias. The results are shown in Table 1.

EXAMPLE 10

An electrophotographic photosensitive member was prepared in the same manner as in Example 9 except that the protecting layer was replaced by the one of Example 8. The results are shown in Table 1.

COMPARATIVE EXAMPLE 3

An electrophotographic photosensitive member was prepared in the same manner as in Example 9 except that the protecting layer was not provided. The results are shown in Table 1.

EXAMPLES 11 AND 12

Ten parts of the monomer used in Example 5, 0.5 parts of the polymerization initiator used in Example 5, and 90 parts of methyl ethyl ketone were mixed. Thereto, 3 parts of fine particulate $SnO_2$ (average particle diameter: 0.05 μm) was added. The mixture was dispersed by means of a midget sand mill with glass beads at 3300 rpm for 6 hours. The resulting liquid dispersion was applied onto an electrophotographic photosensitive member prepared in the same manner as in Comparative Example 1, and onto the other electrophotographic photosensitive member prepared in the same manner as in Example 9 except for forming a protecting layer. The applied liquid was dried at 75° C. for 15 minutes, exposed to ultraviolet light radiation of 1,500 μJ/cm$^2$, and dried further at 120° C. for 60 minutes to form a protecting layer of 3.0 μm. The resulting electrophotographic photosensitive members were evaluated in the same manner as in Example 1 and Example 9. The results are shown in Table 1.

EXAMPLES 13 AND 14

Electrophotographic photosensitive members were prepared in the same manner as in Examples 11 and 12 except that the monomer was replaced with the one used in Example 6. The results are shown in Table 1.

COMPARATIVE EXAMPLES 4 AND 5

Electrophotographic photosensitive members were prepared in the same manner as in Examples 11 and 12 except that the monomer was replaced with the one used in Comparative Example 2. The results are shown in Table 1.

EXAMPLE 15

A solution was prepared by mixing 10 parts of the monomer employed in Example 1, 0.5 parts of the polymerization initiator employed in Example 1, 250 parts of methyl ethyl ketone, and 250 parts of isopropanol. Another solution was prepared by mixing 40 parts of a thermoplastic modified polyethylene terephthalate (weight-average molecular weight: 20,000) and 500 parts of hexafluoroisopropanol. The two solutions were mixed, and the mixture was applied on an electrophotographic photosensitive member prepared in the same manner as in Comparative Example 1 by spray coating. The applied coating was dried at 60° C. for 5 minutes, exposed to ultraviolet light irradiation of 1,500 $\mu J/cm^2$, and further dried at 120° C. for 60 minutes to form a protecting layer of 1.1 $\mu m$ thick. The resulting photosensitive member was evaluated in the same manner as in Example 1. The results are shown in Table 1.

EXAMPLE 16

An electrophotographic photosensitive member was prepared and evaluated in the same manner as in Example 15 except that the monomer of Example 1 was replaced with the one used Example 2. The results are shown in Table 1.

TABLE 1

| | Abrasion test Weight loss (mg) | Scratch test Depth (μm) | Test with Commercial Machine: Abrasion amount (mg) | Dark portion potential drop (V) | Fogging of image | Remark |
|---|---|---|---|---|---|---|
| Example | | | | | | |
| 1 | 0.33 | 0.5 | 1.2 | 10 | None | |
| 2 | 0.32 | 0.5 | 1.6 | 15 | None | |
| 3 | 0.01 | 0.2 | 0.1 | 5 | None | |
| 4 | 0.02 | 0.1 | 0.3 | 10 | None | |
| 5 | 0.02 | 0.1 | 0.0 | 10 | None | |
| 6 | 0.04 | 0.2 | 0.3 | 15 | None | |
| 7 | 0.01 | 0.1 | 0.1 | 5 | None | |
| 8 | 0.04 | 0.4 | 0.2 | 10 | None | |
| 9 | 0.02 | 0.3 | 0.1 | 5 | None | |
| 10 | 0.03 | 0.5 | 0.3 | 5 | None | |
| 11 | 0.15 | 0.3 | 1.2 | 15 | None | |
| 12 | 0.15 | 0.5 | 1.3 | 10 | None | |
| 13 | 0.11 | 0.6 | 0.9 | 10 | None | |
| 14 | 0.12 | 0.7 | 1.4 | 15 | None | |
| 15 | 0.09 | 0.3 | 0.7 | 15 | None | |
| 16 | 0.10 | 0.5 | 0.9 | 10 | None | |
| Comparative example | | | | | | |
| 1 | 9.60 | 5.1 | 10.3 | 50 | Fogging | |
| 2 | 0.43 | 0.6 | 3.2 | 30 | None | |
| 3 | 9.35 | 5.3 | — | — | — | No image formed after 100 sheet copying |
| 4 | 1.12 | 1.1 | 5.1 | 30 | Fogging | |
| 5 | 1.35 | 0.9 | — | — | — | No image formed after 5000 sheet copying |

What is claimed is:

1. An electrophotographic photosensitive member comprising an electroconductive support and a photosensitive layer formed thereon, the surface layer of the electrophotographic photosensitive member containing a polymerization reaction product of a monomer compound by the following formula:

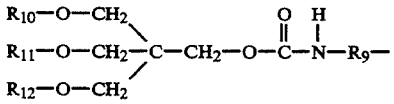

-continued

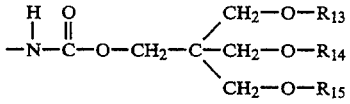

wherein $R_9$ is an alkylene group, an arylene group, a bivalent heterocyclic group or a group derived by combination thereof which may be substituted, and $R_{10}$, $R_{11}$, $R_{12}$, $R_{13}$, $R_{14}$, and $R_{15}$ are independently hydrogen or $—R_{16}—C(R_{17})=CH_2$, $R_{16}$ being a substituted or unsubstituted alkylene group, —O—, —CO, —NH—, or —S—, or a group derived by combination thereof, $R_{17}$ being hydrogen, methyl, or phenyl, and not more than one of $R_{10}$ to $R_{15}$ are simultaneously hydrogen.

2. An electrophotographic photosensitive member according to claim 1, wherein the group $R_{17}$ is hydrogen.

3. An electrophotographic photosensitive member according to claim 1, wherein the group $R_9$ is selected form $—C_6H_3(CH_3)—$, $—C_6H_4—CH_2—C_6H_4—$, and $—C_6H_4—$.

4. An electrophotographic photosensitive member according to claim 1, wherein the group $R_9$ is selected form $—C_6H_3(CH_3)—$, and $—C_6H_4—$.

5. An electrophotographic photosensitive member according to claim 1, wherein the surface layer is a photosensitive layer.

6. An electrophotographic photosensitive member according to claim 1, wherein the surface layer is a protecting layer.

7. An electrophotographic photosensitive member according to claim 1, wherein the photosensitive layer comprises a charge-generating layer and a charge-transporting layer.

8. An electrophotographic photosensitive member according to claim 7, wherein the charge-generating layer is the surface layer.

9. An electrophotographic photosensitive member according to claim 7, wherein the charge-transporting layer is the surface layer.

10. An electrophotographic photosensitive member according to claim 1, wherein the photosensitive layer is a single layer.

11. An electrophotographic photosensitive member according to claim 1, wherein the electrophotographic photosensitive member has a subbing layer between the photosensitive layer and the electroconductive support.

12. An electrophotographic apparatus, comprising an electrophotographic photosensitive member, an image forming means for forming a latent image, a developing means for developing the latent image, and a transferring means for transferring a developed image to a transfer-receiving material, said electrophotographic photosensitive member comprising an electroconductive support and a photosensitive layer formed thereon, the surface layer of the electrophotographic photosensitive member containing a polymerization reaction product of a monomer compound represented by the following formula:

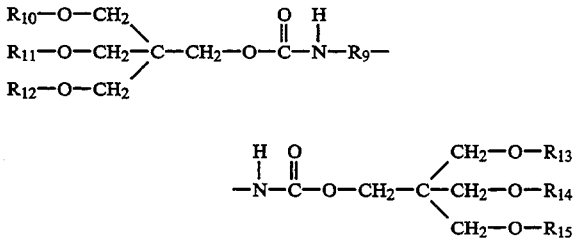

wherein $R_9$ is an alkylene group, an arylene group, a bivalent heterocyclic group or a group derived by combination thereof which may be substituted, and $R_{10}$, $R_{11}$, $R_{12}$, $R_{13}$, $R_{14}$, and $R_{15}$ are independently hydrogen or $—R_{16}—C(R_{17})=CH_2$, $R_{16}$ being a substituted or unsubstituted alkylene group, —O—, —CO, —NH—, or —S—, or a group derived by combination thereof, $R_{17}$ being hydrogen, methyl, or phenyl, and not more than one of $R_{10}$ to $R_{15}$ are simultaneously hydrogen.

13. A device unit comprising an electrophotographic photosensitive member, a charging means, and a cleaning means, said electrophotographic photosensitive member comprising an electroconductive support and a photosensitive layer formed thereon, the surface layer of the electrophotographic photosensitive member containing a polymerization reaction product of a monomer compound represented by the following formula:

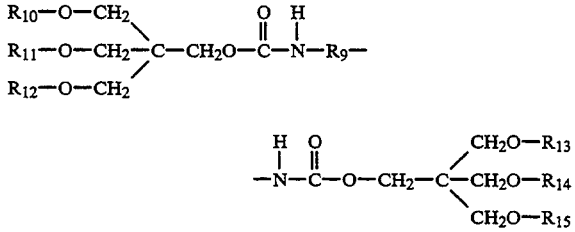

wherein $R_9$ is an alkylene group, an arylene group, a bivalent heterocyclic group or a group derived by combination thereof which may be substituted, and $R_{10}$, $R_{11}$, $R_{12}$, $R_{13}$, $R_{14}$, and $R_{15}$ are independently hydrogen or $—R_{16}—C(R_{17})=CH_2$, $R_{16}$ being a substituted or unsubstituted alkylene group, —O—, —CO, —NH—, or —S—, or a group derived by combination thereof, $R_{17}$ being hydrogen, methyl, or phenyl, and not more than one of $R_{10}$ to $R_{15}$ are simultaneously hydrogen, said unit holding integrally the electrophotographic photosensitive member, the charging means and the cleaning means, and being removable from the main body of an electrophotographic apparatus.

14. A device unit according to claim 13, wherein the device unit comprises a developing means.

15. A facsimile machine comprising an electrophotographic apparatus and an information-receiving means for receiving image information from a remote terminal, said electrophotographic apparatus comprising an electrophotographic photosensitive member, said electrophotographic photosensitive member comprising an electroconductive support and a photosensitive layer formed thereon, the surface layer of the electrophotographic photosensitive member containing a polymerization reaction product of a monomer represented by the following formula:

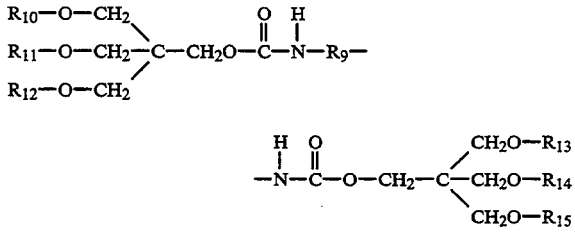

wherein $R_9$ is an alkylene group, an arylene group, a bivalent heterocyclic group or a group derived by combination thereof which may be substituted, and $R_{10}$, $R_{11}$, $R_{12}$, $R_{13}$, $R_{14}$, and $R_{15}$ are independently hydrogen or $—R_{16}—C(R_{17})=CH_2$, $R_{16}$ being a substituted or unsubstituted alkylene group, —O—, —CO, —NH—, or —S—, or a group derived by combination thereof, $R_{17}$ being hydrogen, methyl, or phenyl, and not more than one of $R_{10}$ to $R_{15}$ are simultaneously hydrogen.

* * * * *